United States Patent [19]

Kelly et al.

[11] Patent Number: 5,014,473

[45] Date of Patent: May 14, 1991

[54] APPARATUS AND METHOD FOR LIFTING TILT-UP WALL CONSTRUCTIONS

[75] Inventors: David L. Kelly; Steven A. Bennetts, both of Sacramento, Calif.

[73] Assignee: The Burke Company, Sacramento, Calif.

[21] Appl. No.: 481,870

[22] Filed: Feb. 20, 1990

Related U.S. Application Data

[62] Division of Ser. No. 327,313, Mar. 22, 1989, Pat. No. 4,930,269.

[51] Int. Cl.[5] ..... E02H 12/34

[52] U.S. Cl. ..... 52/125.5; 52/701; 294/82.35; 294/89

[58] Field of Search ..... 52/125.5, 125.6, 124.1, 52/124.2, 125.4, 125.3, 701, 706, 707; 294/89, 82.35

[56] References Cited

U.S. PATENT DOCUMENTS 958,978 5/1910 Spencer .
2,772,560 12/1956 Neptune .
3,883,170 5/1975 Fricker et al. ..... 294/83
4,000,591 1/1977 Courtois ..... 52/125
4,173,367 11/1979 Haeussler ..... 294/83
4,173,856 11/1979 Fricker ..... 52/125
4,367,892 1/1983 Holt ..... 294/89
4,437,642 3/1984 Holt ..... 249/175
4,580,378 4/1986 Kelly ..... 52/125
4,671,554 6/1987 Lancelot ..... 294/89

FOREIGN PATENT DOCUMENTS 2610195A 9/1977 Fed. Rep. of Germany .
408235 3/1934 United Kingdom .

*Primary Examiner*—David A. Scherbel
*Assistant Examiner*—Creighton Smith
*Attorney, Agent, or Firm*—Limbach, Limbach & Sutton

[57] ABSTRACT

An improved insert anchor assembly which provides a lifting clevis is disclosed. A novel void former comprising a body and plug to completely surround the lifting clevis is also disclosed. An improved hoisting attachment capable of complimentable receipt within the recess created by the void former is further provided.

6 Claims, 3 Drawing Sheets

APPARATUS AND METHOD FOR LIFTING TILT-UP WALL CONSTRUCTIONS

This is a divisional of application Ser. No. 327,313, filed Mar. 22, 1989 U.S. Pat. No. 4,930,269.

BACKGROUND OF THE INVENTION

The field of this invention is apparatus and methods for hoisting and positioning prefabricated tilt-up concrete slabs. More specifically, the invention relates to improvements in anchor assemblies, void formers and clutch assemblies of such apparatus.

Prefabricated concrete walls or panels are common components of building constructions. Such panels are generally cast in a horizontal position where they are allowed to set. The hoisting and positioning of the finished panel presents problems in that the panels are very heavy and difficult to handle without cracking or breaking. Preliminary attempts to solve this problem can be found in U.S. Pat. No. 3,883,170, to Fricker et al., disclosing the use of an anchor imbedded in a concrete slab as a point of attachment and lifting in combination with a hoisting shackle, and in U.S. Pat. Nos. 4,367,892 and 4,437,642, to Holt, disclosing the use of a t-shaped anchor also for use with a hoisting shackle.

SUMMARY OF THE INVENTION

The present invention provides many advantages over the previous hoisting systems described above. First, it employs an anchor in the form of a lifting clevis and which is supported by anchor bases. Such anchors have greater strength in that they are less prone to bend or shear during the lifting process and are also less expensive to manufacture since less costly materials and production processes may be employed. Such anchors are also advantageous in that they provide two points of attachment for anchor supports, as well as additional steel reinforcement in the panel, thereby permitting stress to be distributed more broadly in the panel.

The invention also provides a void former which is asymmetric in configuration for producing a uniquely shaped recess that allows access to the clevis of the anchor in but one way. The void former comprises a body and plug configured to ensure that the clevis is fully and completely exposed once the slab is set.

The clutch assembly is proportioned for complimentable and snug receipt within the recess produced by the void former, and is provided with hoisting means. The clutch assembly engages the anchor by means of a linear engaging pin. Once coupled, the clutch assembly is capable of little if any movement about the clevis. Such a configuration minimizes the chances that the anchor or panel will become damaged during hoisting. Furthermore, the clutch assembly of the present invention provides an easy, reliable and safe means for engaging the anchor when the slab is horizontal and for disengaging when the slab is vertically placed, particularly where the anchors become located high up on the slab after placement.

A principal object of this invention is to provide an improved anchor which has a better shock-load resistance and is less likely to fail when stressed, which gives extra embedment strength and which is easier and less costly to fabricate.

Another object of this invention is to provide an improved void former for use with the improved anchor.

A further object of this invention is to provide an improved clutch which mates more securely with an anchor imbedded in a concrete slab, which is easier to engage with and places less stress on an anchor, and which provides a more reliable, less stressful range of motion relative to the concrete panel.

DESCRIPTION OF THE PREFERRED EMBODIMENT

Figure 1:
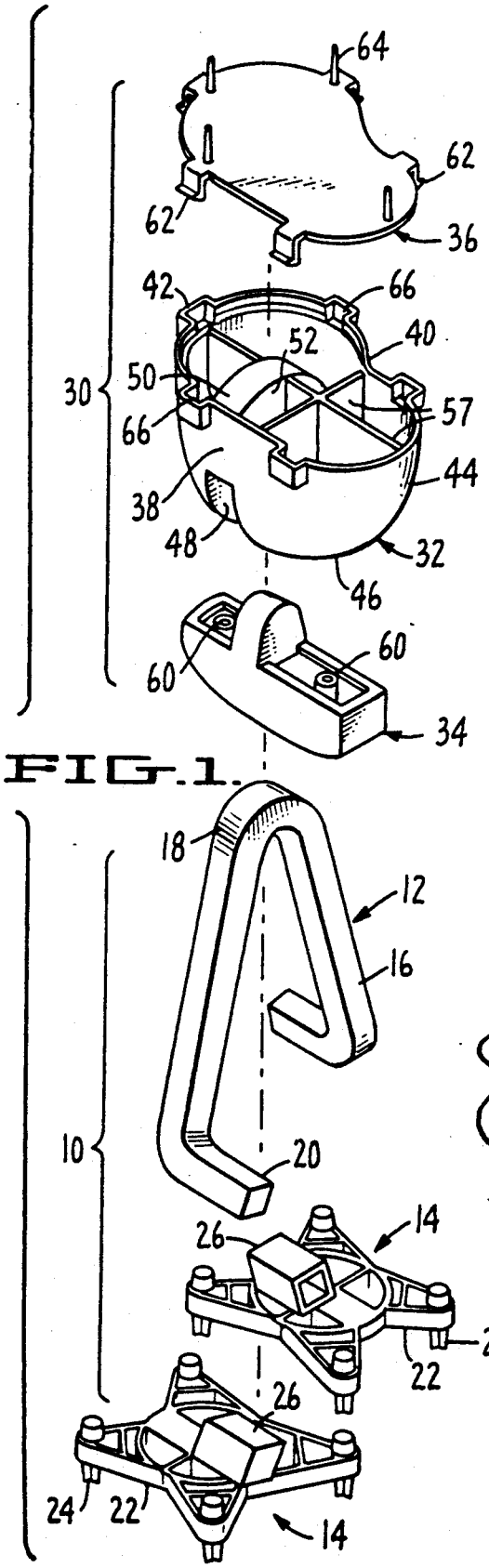
FIG. 1 is an exploded view in perspective showing the anchor assembly and void former of the invention.

With reference to the drawings, a tilt-up concrete slab 1 which is generally cast at the job site in horizontal, ground supported form, not shown, is cast around an anchor assembly 10 and a void former 30.

The anchor assembly 10 comprises a wire anchor 12 and two anchor supports 14. The wire anchor 12 is formed from a quandrangularly configured wire segment (not shown) by bending the segment substantially in half to form two legs 16 joined at an apex or clevis 18. The legs 16 diverge from the clevis 18 at an angle of 34°-36°. Each leg 16 of the wire anchor 12 is further bent to form a distal tip 20. The distal tips 20 diverge out of a plane defined by the clevis 18 and legs 16 at an angle of 88°-92°. The material of the wire anchor is metallic, preferably steel.

The wire anchor 12 is supported and positioned within the concrete slab 1 by anchor supports 14. Each anchor support 14 comprises a platform 22 supported by foot elements 24. The upper surface of the platform is provided with an apertured box 26 complemental in shape to and capable of snug receipt over a distal tip 20 of the wire anchor 12. The anchor support 14 can be made of any durable material, such as polymer plastic.

The void former 30, shown in FIGS. 1, 4, 5 and 6, is comprised of a body 32, a plug 34 and a lid 36. The body 32 is asymmetrically configured and is defined exteriorly by a flat side wall 38, a partially flat, partially curved side wall 40, a flattened end wall 42, a curved end wall 44, and a transversely curved underside wall 46.

The body 32 is provided on its underside with a socket 48 for complimentable receipt of the clevis 18 of the wire anchor 12 and the plug 34. The socket 48 is defined by an interior sloping wall 50, interior side walls 52, an interior receiving wall 54, and interior coupling walls 56. The interior receiving wall 54 is provided with pegs or dowels 58 for mating with and holding the plug 34 in place.

The plug 34 is configured for snug receipt within the socket 48 in which the clevis 18 of the wire anchor 12 is already in place and is provided with peg sockets 60 for receipt of the pegs 58 of the interior receiving wall 54 of the socket 48. The plug 34 is dimensioned so that when the plug 34 is in place within the body 32 of the void former 30, the exterior surface of the plug 34 is flush with the exterior surface of the body 32.

The lid 36 comprises peripherally distributed, downwardly projected camming lugs 62 and a plurality of upwardly projecting locator rods 64. The camming lugs 62 are adapted to snap into and interengage with an equal number of lug sockets 66 which are peripherally distributed along the upper edge of the body 32.

Emplacement of the wire anchor 12 within the concrete slab 1 takes place as follows. The wire anchor 12 is connected to the anchor supports 14 by sliding each of the distal tips 20 of the wire anchor 12 into the apertured box 26 of the anchor support 14. The void former 30 is then assembled about the clevis 18 of the wire anchor 12. First, the body 32 of the void former 30 is placed over the clevis 18 such that the clevis 18 is snugly received with the socket 48. The plug 34 is then inserted beneath the body 32/wire anchor 12 combination and snapped securely in place by engaging the peg sockets 60 with pegs 58, thereby enclosing the clevis 12 of the wire anchor. The lid 36 is snapped into position on the top of the body 32 by lockingly engaging the camming lugs 62 with the lug sockets 66. The combination of anchor assembly 10 and void former 30 is then positioned as desired on the wall form. The slab is then poured and cured.

Figure 4:
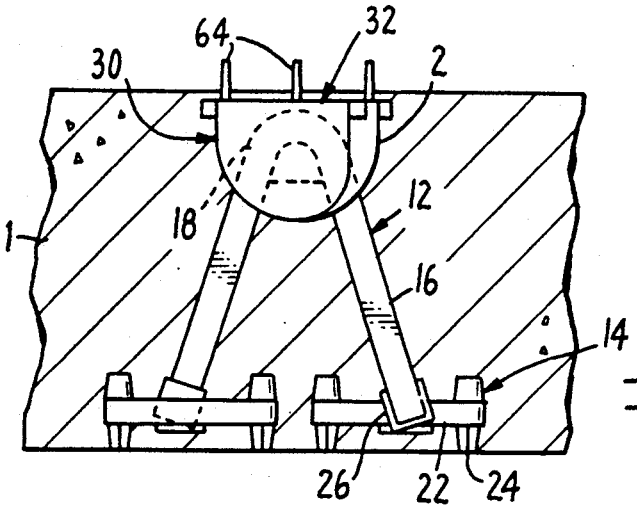
FIG. 4 is a cross-sectional elevational view showing the anchor assembly and void former in place within a concrete panel.
Figure 5:
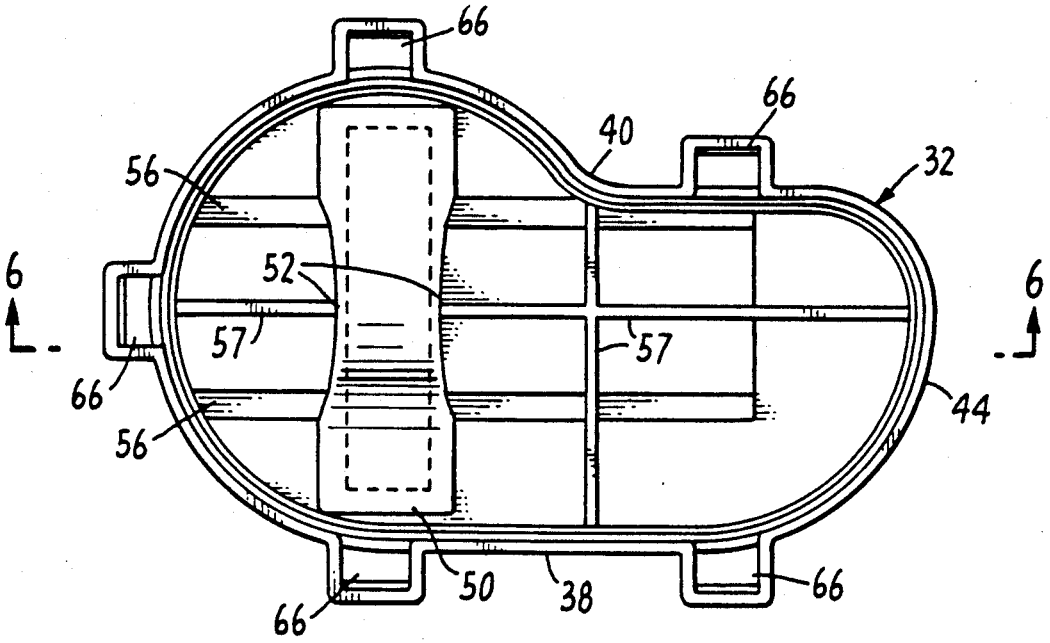
FIG. 5 is a top plan view of the void former in open condition.
Figure 6:
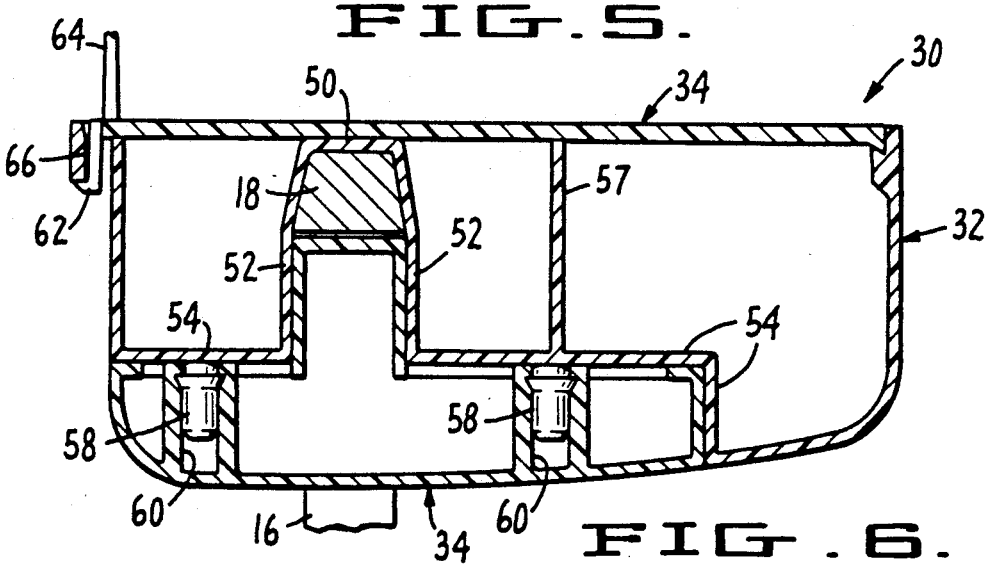
FIG. 6 is a view in cross-section of the void former in closed condition, taken on the plane designated by line 6—6 in FIG. 5, coupled to the anchor.

In FIG. 4, the protruding rods 64 show the location of the wire anchor 12 with the slab 1. The thin layer of cement above the void former is then chipped away and the lid 36 popped off. The body 32 of the void former 30 can then be pulled out by gripping and pulling on internal ribs 57 with pliers. Removal of the body 32 creates a recess 2 to the rear of the plug 34. The plug 34 is then gripped by pliers, pulled from under the wire anchor 12 into the recess 2 and then removed.

The clutch assembly 70 comprises a housing 72; a housing cover 74 which is attached to the housing 72 by screw 76; a linear engaging pin 78 slidably mounted within a passage 79 in the housing; and a lever 80 which is comprised of an arm member 82, a shaft member 84 and a handle member 86. The lever 80 is pivotally engaged with pin 78 by means of a stud 88 which is carried by the engaging pin 78 and extends through a slot 90 in the arm member of the lever 80.

Figure 7:
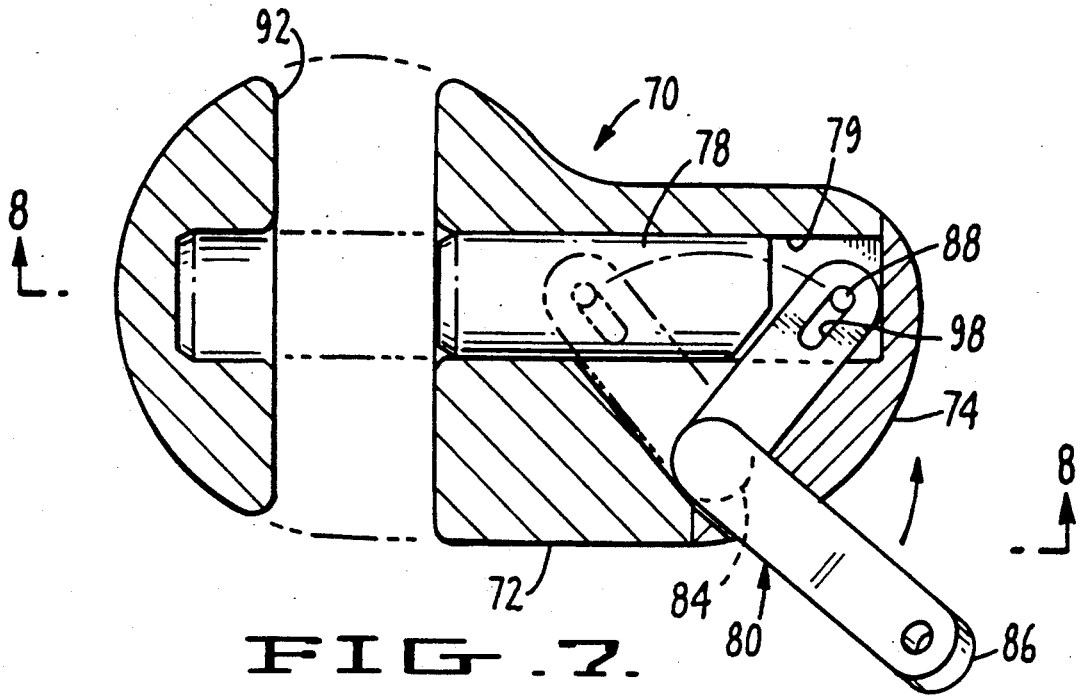
FIG. 7 is a view in cross-section of the clutch, taken on the plane designated by line 7—7 in FIG. 2.
Figure 8:
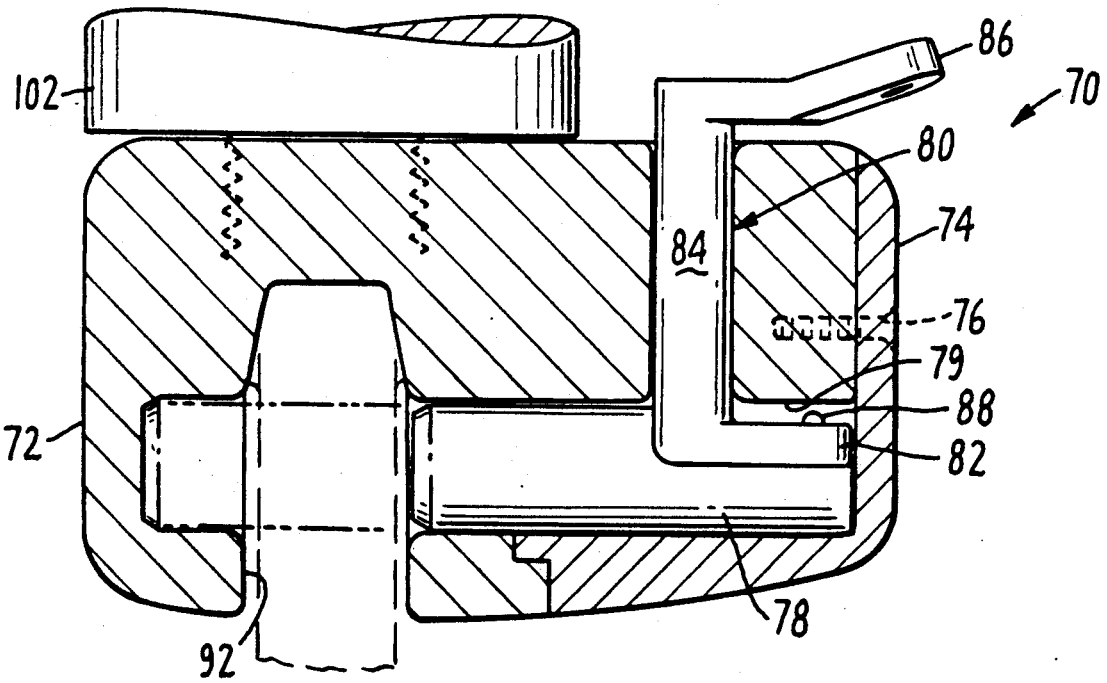
FIG. 8 is a view in cross-section of the clutch, taken on the plane designated by line 8—8 in FIG. 7.

The housing 72 of the clutch assembly 70 is configured for complimentable receipt with the recess 2 left by the void former 30 and further comprises an engagement socket 92 for receipt over the clevis 18 of the wire anchor 12. FIGS. 7 and 8 illustrate the engagement pin 78 in retracted relation relative to the engagement socket.

Figure 2:
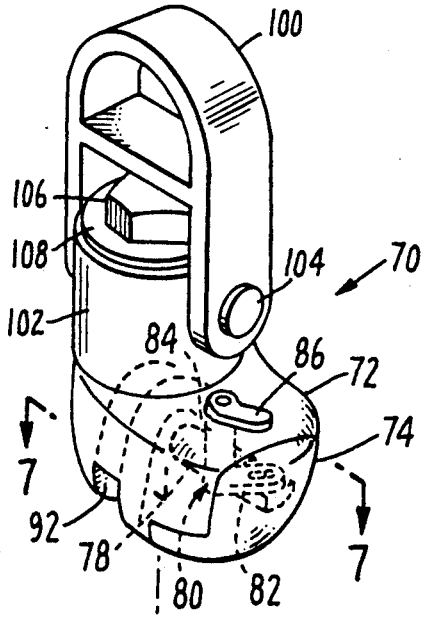
FIG. 2 is a view in perspective showing the clutch assembly of the invention.
Figure 3:
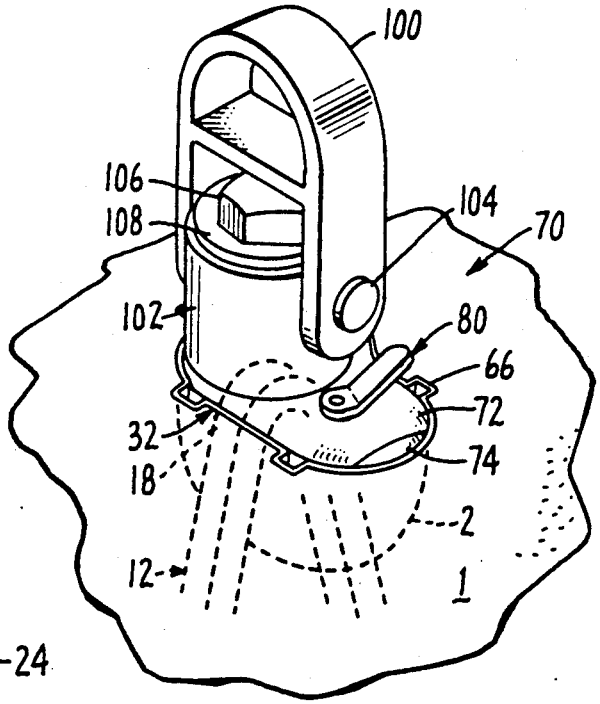
FIG. 3 is a view in perspective showing the clutch assembly engaged with the anchor embedded in a concrete panel.

The clutch assembly 70 is also provided with hoisting means as shown in FIGS. 2, 3 and 8. The hoisting means comprises: a bail 100; an external collar 102 fastened to the bail 100 by dowel pins 104; an internal collar (not shown) on the housing 72 rotatably received in the external collar 102, and a bolt 106 and plate washer 108 which fasten the external collar to the housing 72 for rotation about the internal collar.

Coupling with and hoisting of the concrete slab by the clutch assembly 70 takes place as follows. The housing 72 of the clutch assembly 70 is guided into the recess left by the void former 30 and over the clevis 18 of the imbedded wire anchor 12 with the engaging pin 78 in the retracted position. Once the housing 72 is snugly in place, the clevis 18 is engaged by moving the lever 80 to slide the engaging pin 78 in place. Having securely coupled the clutch assembly 70 to the concrete slab 1, a hoisting cable or rope (not shown) can be attached to the bail 100 with lifting force then applied to position the concrete slab in a desired position. Since the housing 72 is complimentably nested within the recess left by the void former 30, shearing force on the wire anchor 12 is reduced as is the threat of damage to the slab 1 resulting from uncontrolled movement of the clutch assembly 70 in relation to the wire anchor 12. Once the slab 1 is in place, the lever 80 is returned to its original position, thereby sliding the engaging pin 78 into its retracted position and releasing the clutch assembly 70 from the wire anchor 12 and the slab 1.

From the above description, it is apparent that a novel and advantageous apparatus and method for tilting up concrete slabs or panels is described. Although the disclosure above is illustrative of certain exemplary embodiments of the present invention, one skilled in the art will understand that other embodiments are possible which fall within the spirit or the essential characteristics of the invention, the scope of which is set forth in the following claims.

What is claimed is:

1. An anchor assembly for providing a lifting means in a concrete tilt-up slab, said assembly comprising:

a wire anchor of inverted V-shaped configuration having a first and a second leg joined at an apex and lying within a first plane, the legs having distal tips extending laterally out of the first plane; and two anchor bases for supporting and positioning said wire anchor within the concrete slab, said anchor bases connected to said distal tips and lying in a second plane perpendicular to the first plane.

2. The anchor assembly of claim 1 wherein the wire anchor is divided substantially in half at the apex.

3. The anchor assembly of claim 1 wherein the wire anchor is quadrilaterally configured in cross-section.

4. The anchor assembly of claim 1 wherein the legs diverge from the apex at an angle of 34°–36°.

5. The anchor assembly of claim 1 wherein the distal tips diverge from the second plane in substantially opposite directions.

6. An anchor assembly for providing lifting means in a concrete tilt-up slab, said assembly comprising:

a wire anchor quadrangular in cross-section and of an inverted V-shaped configuration, said anchor having two legs joined at an apex and diverging therefrom at an angle of 34°–36°, the legs substantially equivalent in length, lying within a first plane, and having distal tips extending laterally out of the first plane in substantially opposite directions; and two anchor bases for supporting and positioning said wire anchor within the concrete slab, said anchor bases connected to said distal tips and lying in a second plane perpendicular to the first plane.

* * * * *